United States Patent [19]

Klose

[11] Patent Number: 4,572,688

[45] Date of Patent: Feb. 25, 1986

[54] BALL-POINT PEN

[75] Inventor: Odo Klose, Wuppertal, Fed. Rep. of Germany

[73] Assignee: Präsenta KG Weber & Co., Solingen, Fed. Rep. of Germany

[21] Appl. No.: 514,458

[22] Filed: Jul. 18, 1983

[30] Foreign Application Priority Data

Jul. 16, 1982 [DE] Fed. Rep. of Germany ... 8220321[U]
Jul. 16, 1982 [DE] Fed. Rep. of Germany ... 8220323[U]

[51] Int. Cl.[4] ..... B43K 7/12; B43K 24/04

[52] U.S. Cl. ..... 401/112; 401/113; 401/114

[58] Field of Search ..... 401/109, 99, 112, 113, 401/114, 65

[56] References Cited

U.S. PATENT DOCUMENTS

| | | | |
|---|---|---|---|
| 2,748,748 | 6/1956 | Lovejoy | 401/114 |
| 2,933,067 | 4/1960 | Larson | 401/113 |
| 3,093,921 | 6/1963 | Peterson | 401/112 X |
| 3,951,554 | 4/1976 | Jonkers | 401/112 |
| 4,140,408 | 2/1979 | Mizutani | 401/65 |

FOREIGN PATENT DOCUMENTS

| | | | |
|---|---|---|---|
| 767025 | 10/1971 | Belgium . | |
| 1009530 | 12/1954 | Fed. Rep. of Germany | 401/112 |
| 89748 | 6/1967 | France | 401/112 |
| 1553910 | 1/1969 | France | 401/114 |
| 509189 | 1/1955 | Italy | 401/114 |
| 397466 | 2/1966 | Switzerland | 401/113 |

*Primary Examiner*—Steven A. Bratlie
*Attorney, Agent, or Firm*—Martin A. Farber

[57] ABSTRACT

A ball-point pen is disclosed, having a push button which can be displaced to a limited extent in longitudinal direction of the ball-point pen housing so as to extend the cartridge which is urged by spring in the inward direction, and having a detent means for locking the inwardly-pushed position of the push button. In order to obtain a simple structural form as well as a mechanism which operates trouble-free, it is proposed that the push button be developed as a slide plate and have on its wide side a tongue cut therefrom which extends resiliently transversely out of the wide side and bears the detent tooth of the detent means.

23 Claims, 23 Drawing Figures

FIG.10
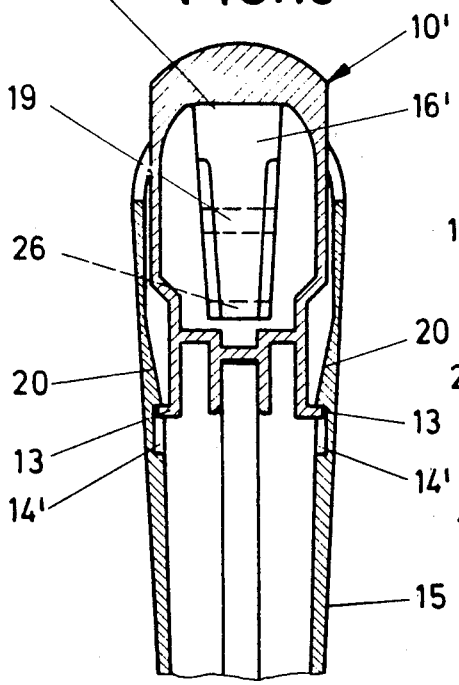
FIG.11
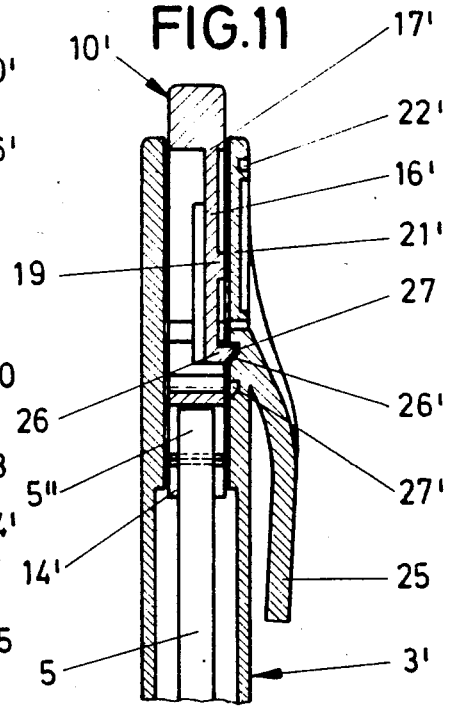
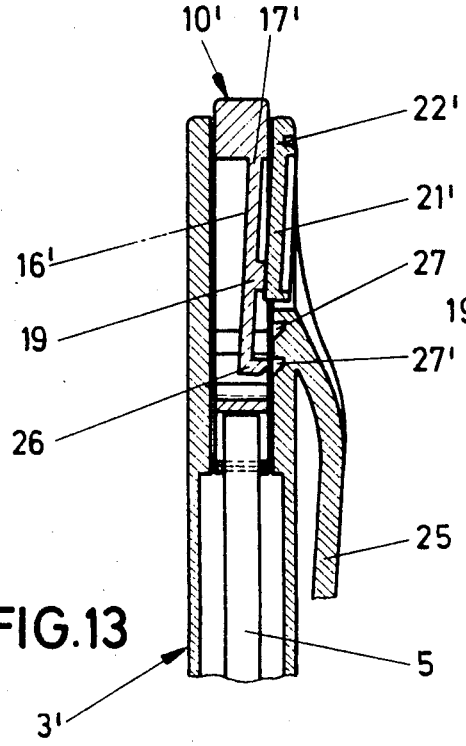
FIG.13
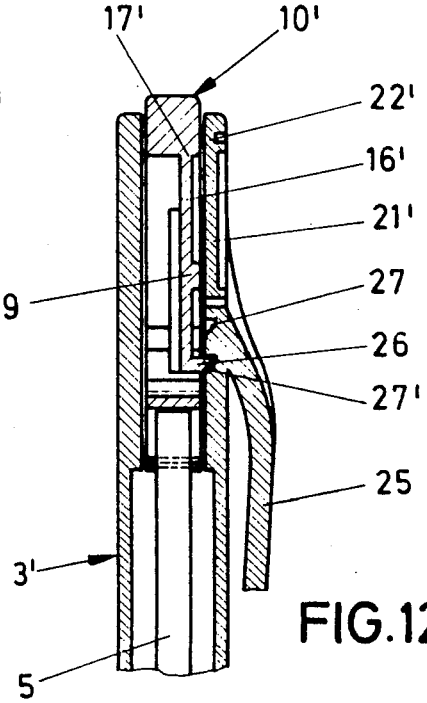
FIG.12

FIG.14
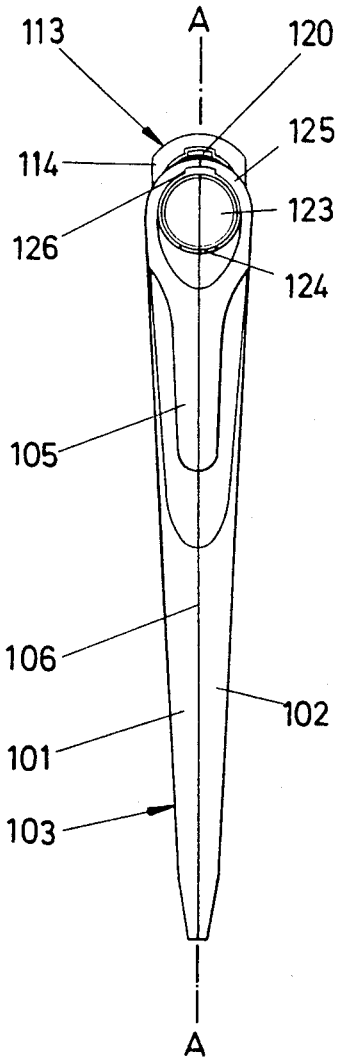
FIG.15
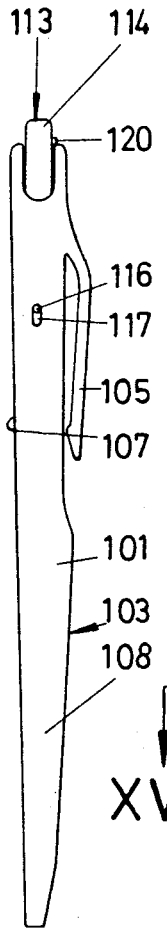
FIG.16
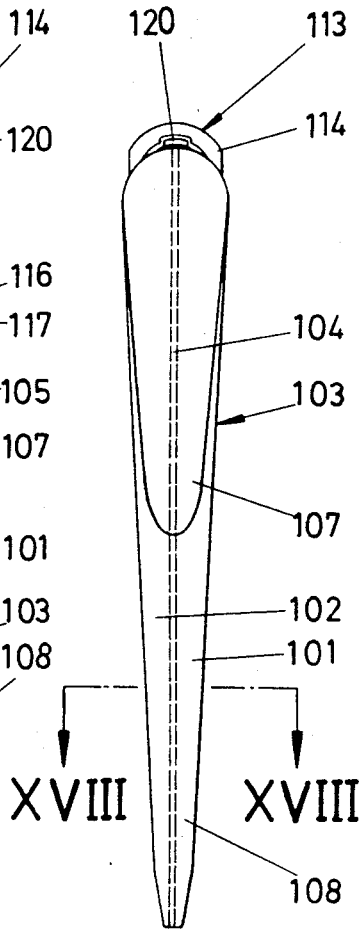
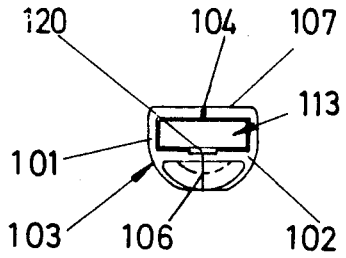
FIG.17
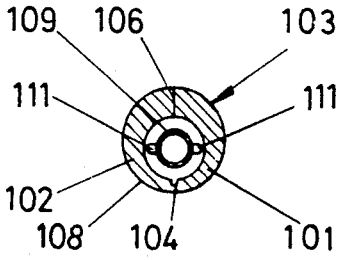
FIG.18

BALL-POINT PEN

The invention relates to a ball-point pen having a push button which is displaceable to a limited extent in the longitudinal direction of the housing of the ball-point pen for extending the cartridge beyond the housing into a writing position, the cartridge being biased by a spring in the inward direction, and a detent means for locking the inwardly pushed position of the push button.

Ball-point pens are known in which the detent means is developed in the form of a cam. Such constructions are frequently trouble-prone, with the result that the ball-point pen cartridge can be moved only with great difficulty, if at all.

The object of the present invention is to create a ball-point pen of the above-mentioned type in a manner which is simple to manufacture, in which the mechanism for the detent means operates substantially trouble-free.

This object is achieved in accordance with the present invention by developing the push button as a slide plate and providing it on its wide side with a tongue freely cut therefrom which resiliently springs transversely out from said wide side and bears the detent tooth of the detent device. Herein the term "freely cut" with reference to the tongue does not necessarily mean that the tongue is formed by actual cutting from the slide plate, since the invention preferably contemplates an injection moulding of the slide plate and its tongue.

As a result of this development, there is created a ball-point pen of the above-indicated type which is of simple construction and is characterized by a high degree of reliability. Trouble-prone cams can be dispensed with. The components of the ball-point pen can be manufactured at low cost, preferably by the injection molding of plastics.

The push button which brings the ball-point pen cartridge into its writing position is now formed by the slide plate. This plate extends beyond the upper end of the ball-point pen by an amount at least equal to the stroke of the slide plate. If the ball-point pen cartridge is to be brought into the active position, the slide plate must be moved in the direction into the housing, whereupon the tongue which protrudes resiliently from the wide side engages by a detent tooth behind a corresponding projection on the ball-point pen and thus secures the ball-point pen cartridge in this position. It can only be brought by intentional action out of this position, namely by suitable transverse action on the slide plate, whereby the detent engagement is released. The compression spring acting on the ball-point pen cartridge then brings both the ball-point pen cartridge and the slide plate back into their initial position.

One advantageous further development resides in providing a push-button plate—swingable against spring action—of the ball-point pen housing in front of the detent tongue. Accordingly, the transverse displacement of the detent tongue which serves for the release takes place via this push-button plate. For example, this push-button plate can be developed, as a removable part, together with the clip which serves for the attachment of the ball-point pen. The push-button plate can serve to provide an area for inscriptions.

It has furthermore been found favorable for the slide plate to have two outwardly protruding projections which extend into longitudinally directed recesses in the wall of the housing of the ball-point pen. In this way the path of displacement of the slide plate is limited in simple manner without additional structural parts being required for this.

A stable structural shape and a pleasing appearance are imparted to the ball-point pen by providing for the ball-point pen housing, which is developed flat in its upper region, to taper down towards the lower end. This flat shape is of interest as a flat area for inscriptions.

In order to keep the friction as low as possible upon operation, the detent tooth of the detent tongue is arranged on the free end of said tongue and has a run-on bevel shape as a hasp or catch.

One particularly favorable solution is characterized by the fact that the base of the detent tongue is located in the upper region of the slide plate. Accordingly, the detent parts are completely concealed from sight.

A reliable release of the ball-point pen cartridge when in the writing position is assured by forming the push-button plate circularly and connecting it by a film-hinge with the ball-point pen housing, the film-hinge being a hinge formed by the material of the housing at a thin portion constituting a film. A sufficiently large surface for engagement for a person's actuating hand or the fingers thereof is always present for the release.

With a transmission projection being provided between the detent tongue and the push-button plate, the push-button plate always acts at the proper place on the detent tongue.

Advantages in assembly result by arranging run-on bevels in front of the longitudinally directed recess. The mounting of the slide plate can be effected by simple insertion. The projections of the slide plate thereof strike against the run-on bevel and are guided until they can engage into the recesses.

Another advantageous feature is that the longitudinally directed recesses are open towards the outside. As a result, there is the possibility of pressing the projections of the slide plate inwardly from the outside so as to release the slide plate in order to change a cartridge.

For simple manufacture of the housing and easy assembling of the cartridge-actuating mechanism, one variant of the ball-point pen housing consists of two interconnected shell parts which abut in a longitudinal plane. The joint of the two parts forming the ball-point pen housing now lies in the longitudinal plane. These shell parts permit simpler injection molds, due to the smaller mold depth. Furthermore, the mechanical parts can be inserted before the two shell parts are connected together. Accordingly, economic advantages are obtained in manufacture which reduce the cost of production of the ball-point pen.

One advantageous feature is that the two shaft parts are locked, bonded or welded together at the opposite side of the housing. By use of the film hinge, therefore, only a single injection molding is required. Furthermore, the connection of the shell parts need only be effected on one side of the housing. Various possibilities for this exist, such as, for instance, an insertion interlocking, bonding or welding.

It has been found favorable for the longitudinal plane of the joint to extend through the clip.

One possibility of arriving at a straight continuous film is to form the housing in its upper region flattened transverse to the length of the longitudinal plane of the joint and tapering towards the lower end, and the flat side which bears the film hinge connects tangentially to the tapered rounded section.

Advantages in the arrangement of the cartridge-actuating mechanism result from arranging the cartridge-actuating mechanism in the upper region of the flat section.

With the above and other objects and advantages in view, the present invention will become more clearly understood in connection with the detailed description of preferred embodiments, when considered with the accompanying drawings, of which:

FIG. 10 is a partly broken-away section along the line X—X of FIG. 9, with the ball-point pen cartridge in its retracted position;

FIG. 11 is a partly broken-away section along the line XI—XI of FIG. 8;

FIG. 12 is a partly broken-away section corresponding to FIG. 11 but with the ball-point pen cartridge in writing position;

FIG. 13 is a partly broken-away section corresponding to FIG. 12, the push-button plate being acted on, with release of the detent tongue;

FIG. 14 is a view of the ball-point pen according to the third embodiment, with the cartridge in retracted position;

FIG. 15 is a side view of FIG. 14;

FIG. 16 is a rear view of the ball-point pen;

FIG. 17 is a top view of FIG. 14;

FIG. 18 is a section on a larger scale along the line XVIII—XVIII of FIG. 16;

Figures 1, 2, 3, 7:
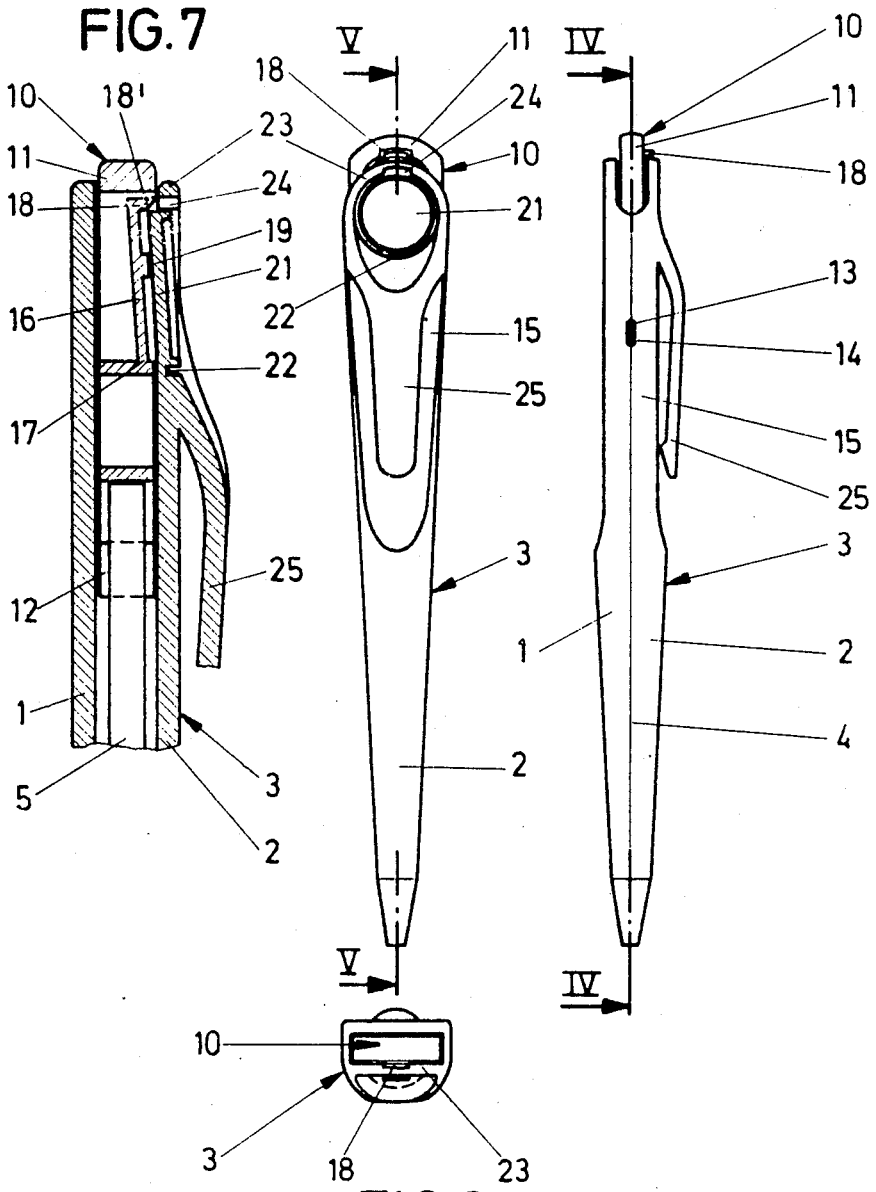
FIG. 1 is a view of a ball-point pen according to the first embodiment.
FIG. 2 is a side view of FIG. 1.
FIG. 3 is a top view of FIG. 1.
FIG. 7 is a partly broken-away section corresponding to FIG. 6, the push-button plate being swung, with release of the detent tongue.

The ball-point pen according to the first embodiment, shown in FIGS. 1 to 8, has a ball-point pen housing 3 consisting of two plastic half-shells 1, 2. The half-shells 1, 2 are connected together at the joint 4 by bonding or welding. The ball-point pen housing 3 created in this manner is developed flat in its upper region and tapers towards the lower end. The tapering proceeds in such a manner that the lower end has a circular shape as seen in cross section.

The inside of the ball-point pen housing 3 receives a ball-point pen cartridge 5. The lower end 5' of the cartridge passes through a compression spring 6 which rests at one end against a projection 7 on the ball-point pen cartridge 5 and at the other end against an inner step 8 on the lower end of the ball-point pen housing 3. In this way the ball-point pen cartridge 5 is biased by the spring in the inward direction.

The upper end 5'' of the ball-point pen cartridge 5 engages into a slot 9, open at one end, in a slide plate 10. The upper end 11 of the slide plate extends beyond the corresponding end of the ball-point pen housing 3, whereby the slide plate 10 serves as push button.

On both sides of the slot 9 downward directed resilient arms 12 extend from the slide plate 10. The outer narrow side of the arms 12 is provided with outwardly protruding projections 13 which extend into longitudinally directed cutouts 14 in the housing wall 15 of the ball-point pen. The length of the cutouts 14 determines the stroke of the slide plate 10.

The slide plate 10 is provided on its wide side with a tongue 16 cut therefrom which extends resiliently transversely from the wide side in the manner that the base 17 of the tongue 16 is located in the lower region. The free end of the tongue 16 has a detent tooth 18 with a run-on bevel 18' formed as a hasp or catch, the tooth extending beyond the wide side of the slide plate 10. In the region between the detent tooth 18 and the base 17 there is a transmission projection 19 which is integral with the tongue. Both the tongue 16 and the slide plate 10 are injection molded from plastic having resilient properties.

In order to be able to coordinate the slide plate easily with the ball-point pen housing by mere insertion, run-on bevels 20 are arranged in front of the outwardly open longitudinally directed cutouts 14. This development permits changing the ball-point pen cartridges. For this, the projections 13 are pushed inward, whereupon the slide plate 10 can be pulled out and a new cartridge introduced.

In front of the detent tongue 16 there extends a flexibly swingable push-button plate 21. It is of circular shape and connected via a film hinge 22 to the ball-point pen housing 3. The push-button plate 21 is flanked by a housing section 23. Its upper end is rounded and extends into the path of the detent tooth 18. For the latter, the housing section 23 forms a notch 24 for engagement.

Figure 4:
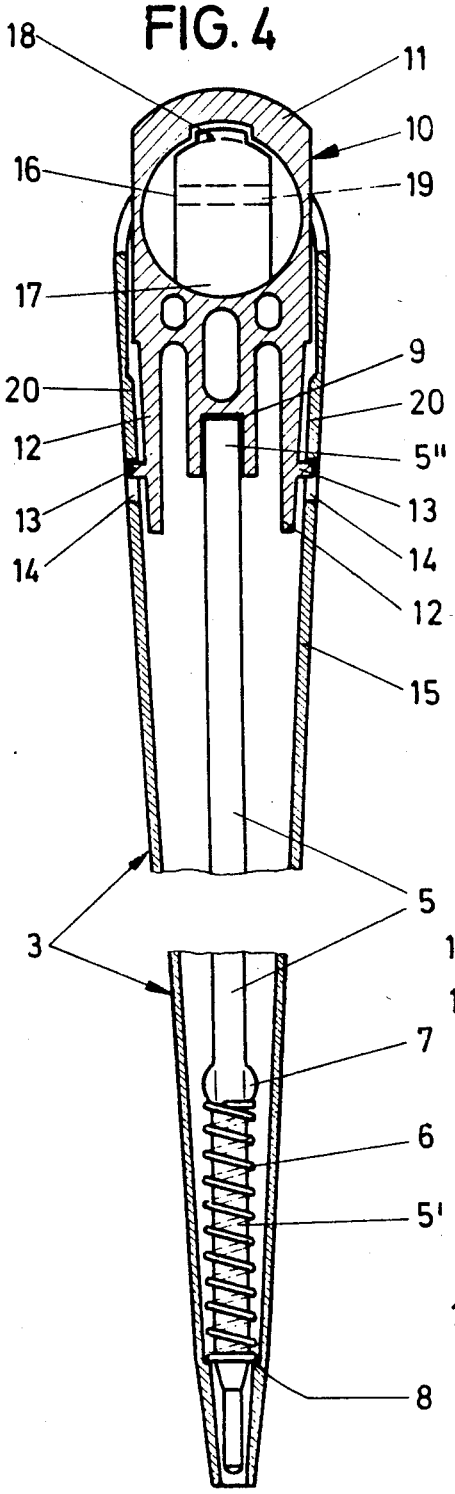
FIG. 4 is a partly broken-away section along the line IV—IV of FIG. 2, the ball-point pen cartridge being in its retracted position.
Figure 5:
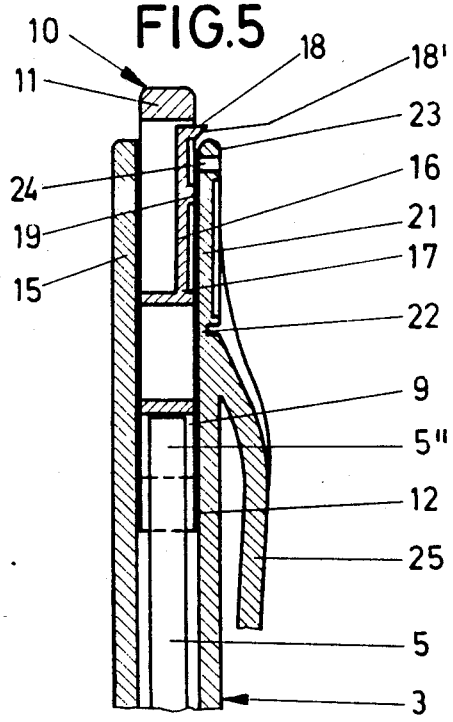
FIG. 5 is a partly broken-away section along the line V—V of FIG. 1, with the ball-point pen cartridge also in the retracted position.
Figure 6:
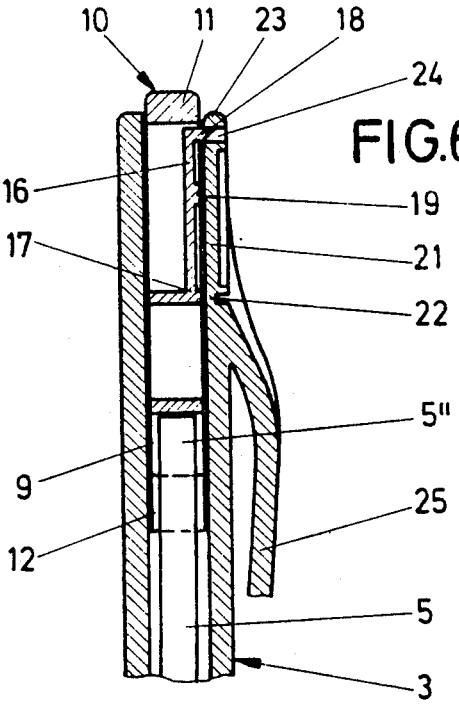
FIG. 6 is a partly broken-away section corresponding to FIG. 5 but with the slide plate displaced inward and the ball-point pen cartridge extended in writing position.
Figures 8, 9:
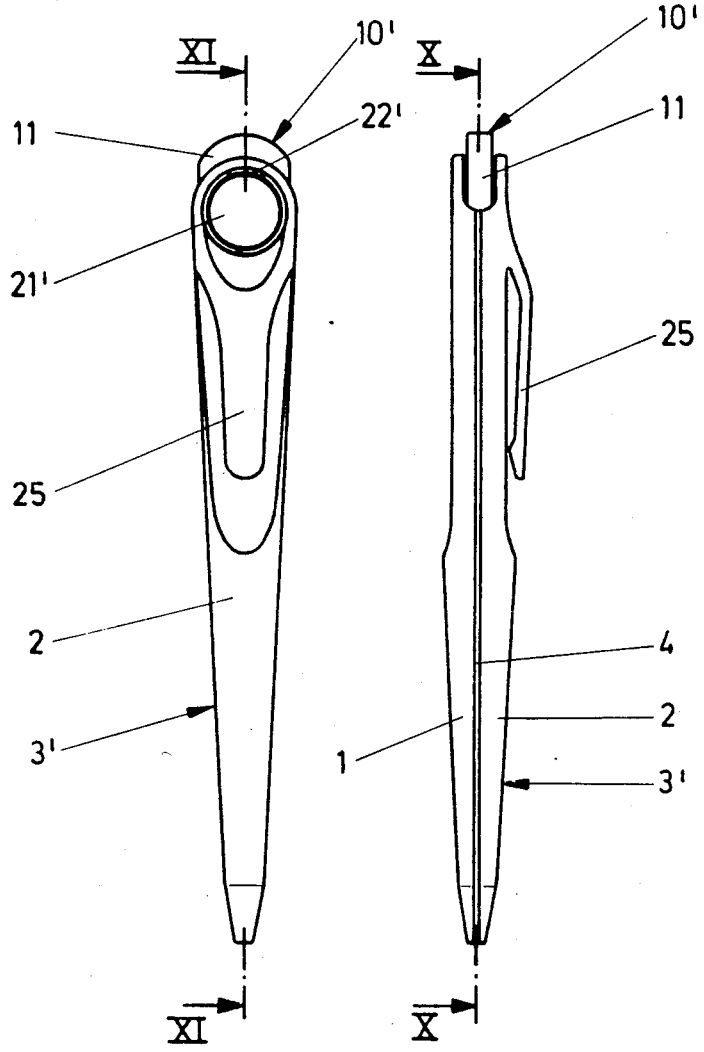
FIG. 8 is a view of a ball-point pen according to the second embodiment.
FIG. 9 is a side view of FIG. 8.
Figure 19:
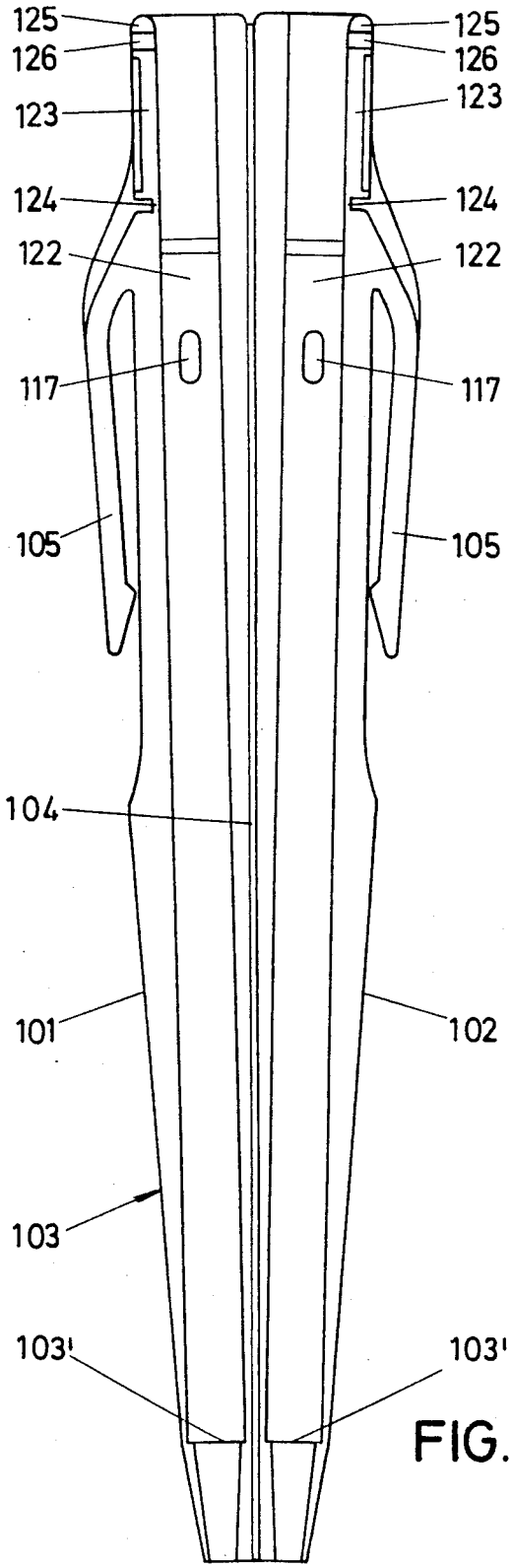
FIG. 19 is a view on a larger scale of the two shell parts connected by a film hinge which form the ball-point pen housing, shown in swung-apart position.
Figure 20:
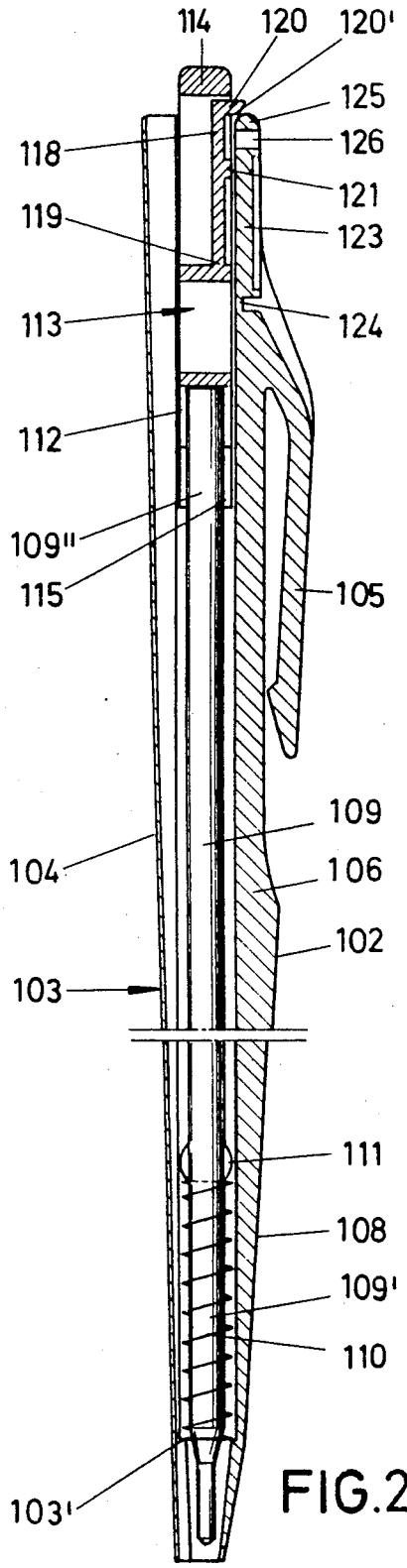
FIG. 20 is a longitudinal section, on a larger scale, through the ball-point pen in the region of the longitudinal plane of the joint.
Figure 21:
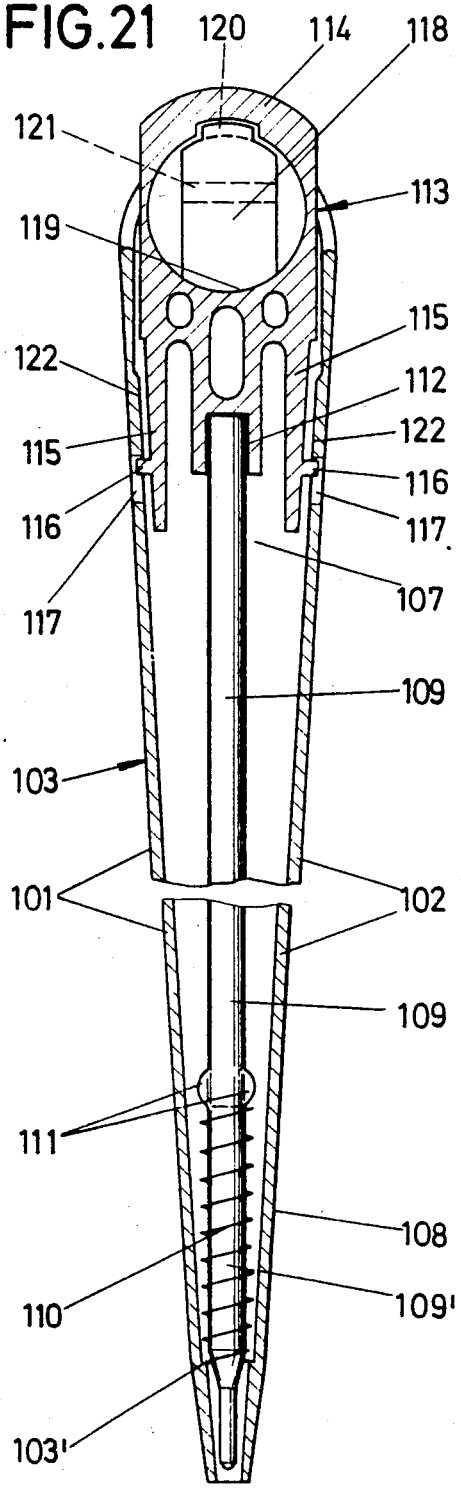
FIG. 21 is a partly broken-away longitudinal section through the ball-point pen transverse to the longitudinal plane of the joint.
Figure 22:
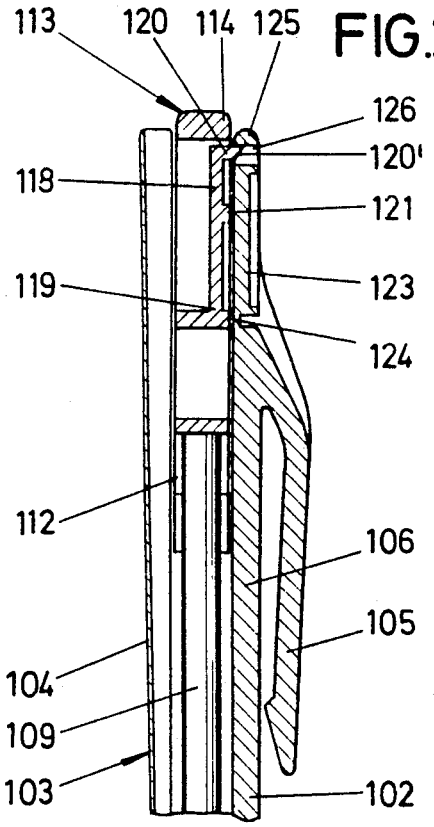
FIG. 22 shows the upper region of the ball-point pen in partly broken away longitudinal section according to FIG. 20, but with the ball-point pen cartridge in writing position.

The manner of operation is as follows: If the ball-point pen cartridge 5, starting from its retracted position shown in FIGS. 4 and 5, is to be brought into the writing position in which it extends beyond the bottom of the housing, the slide plate 10 is pushed in the inward direction at its protruding rounded end 11. Together with this, the ball-point pen cartridge 5 is displaced. During the displacement, the catch-like run-on bevel 18' of the detent tooth 18 contacts and runs on the housing section 23. The detent tongue 16 is resiliently deflected inwardly. As soon as the detent tooth 18 lies at the height of the notch 24, the detent tongue 16 springs out beyond the wide side of the slide plate 10 and passes into the position shown in FIG. 6. The projections 13 have then also moved to the lower, other end of the recesses 14. This secured detent position can be released only intentionally, namely as shown in FIG. 7, by swinging the push-button plate 21 inwardly around the film hinge 22. In the process, it is applied against the transmission projection 19 of the detent tongue 16 and swings it inwardly so that the detent tooth 18 comes out of the notch 24 and releases its engagement with the housing section 23. The compression spring 6 then moves the slide plate 10 via the ball-point pen cartridge 5 back into the starting position shown in FIGS. 4 and 5, the cartridge passing into the retracted position.

In the embodiment shown, on the other side of the film hinge 22 for the push-button plate 21 the housing is continued into a holding clip 25. It would also be possible to develop the holding clip together with the push-button plate as a structural unit which could be removed from the ball-point pen housing 3. The other surface of the push-button plate 21 the housing could also serve as an area for inscriptions.

The slide plate is so developed in cross section that it is surrounded in form-fitting manner by the housing wall 15 of the ball-point pen so as to be non-rotatably, but slidably mounted in the housing.

Identical parts of the second embodiment, shown in FIGS. 8 to 13, bear the same reference numbers. Differing from the first embodiment, the longitudinally directed cutouts 14' are not extended up to the outer wall of the housing. Accordingly, this construction is intended for disposable use. Furthermore, the slide plate 10' is developed in such manner that the base 17' of the detent tongue 16' lies in the upper region of the slide plate 10'. The detent tooth 26 is accordingly at the lower end of the detent tongue. It also forms a catch bevel 26'. The detent tooth 26 cooperates with cutouts 27 and 27' of corresponding cross section on the inner side of the ball-point pen housing 3'.

The push-button plate 21' which serves for the release is connected to the ball-point pen housing 3' by a film hinge 22' provided on the upper end of the housing.

If the ball-point pen cartridge in this embodiment is to be brought into the writing position, the slide plate 10' must be shifted in downward direction, starting from FIGS. 10 and 11. Inward displacement of the detent tongue 16' is effected via the run-on bevel 26' of the detent tongue 16'. When the detent tooth 26 is at the same height as the cutout 27' of the ball-point pen housing 3', the detent tongue can spring resiliently in an outward direction, the detent tooth 26 engaging in the cutout 27' and securing the position of the slide plate 10'. This means that at the same time the ball-point pen cartridge assumes a secured position; see FIG. 12. The release is effected by acting on the push-button plate 21', as shown in FIG. 13. The plate is applied against the transmission projection 19 of the detent tongue 16' and swings the tongue in such a manner that its detent tooth 26 leaves the output 27'. The compression spring 6 then brings the ball-point pen cartridge and slide plate 10' back into the basic position shown in FIGS. 10 and 11. The detent mechanism can be used also at some other suitable place instead of in a ball-point pen.

The ball-point pen according to the third embodiment, shown in FIGS. 14 to 23, has a housing 103 which consists of two plastic shell parts 101, 102. The two shell parts 101, 102 are connected together by a film hinge 104 on one side of the housing and bonded together on the opposite side of the housing. However, welding or a detent connection can also be provided. The longitudinal plane A—A of the joint which passes through the film hinge 104 extends, as shown in particular in FIG. 14, through the clip 105.

It can furthermore be noted from FIG. 14 that the ball-point pen housing 103 is flattened in the upper region transverse to the length of the longitudinal plane A—A of the joint and tapers down towards the lower end, assuming an arrow shape. On the wide sides of this arrow shape are the film hinge 104 and the butt joint 106 of the shell parts 101, 102 which have been swung together. In order to arrive at a straight continuous film hinge 104, the flat side 107 which bears the film hinge 104 connects tangentially to the tapered rounded section 108.

The inside of the ball-point pen housing 103 receives a ball-point pen cartridge 109. The lower end 109' thereof passes through a compression spring 110 which rests at one end against a projection 111 on the ball-point pen cartridge 109 and at the other end against an inner step 131 on the ball-point pen housing 103. In this way the ball-point pen cartridge 109 is biased in the inward direction.

The upper end 109'' on the ball-point pen cartridge 109 engages into a slot 112, open on one end, contained in a slide plate 113. The upper end 114 of the slide plate extends beyond the corresponding end of the ball-point pen housing 103, as a result of which the slide plate 113 serves as push button.

On both sides of the slot 112, downward directed resilient arms 115 extend from the slide plate 113. The outer narrow side of the arms 115 is provided with outwardly protruding projections 116 which extend into longitudinally directed cutouts 117 in the shell parts 101, 102. The length of the cutouts 117 determines the stroke of the slide plate 113.

Figure 23:
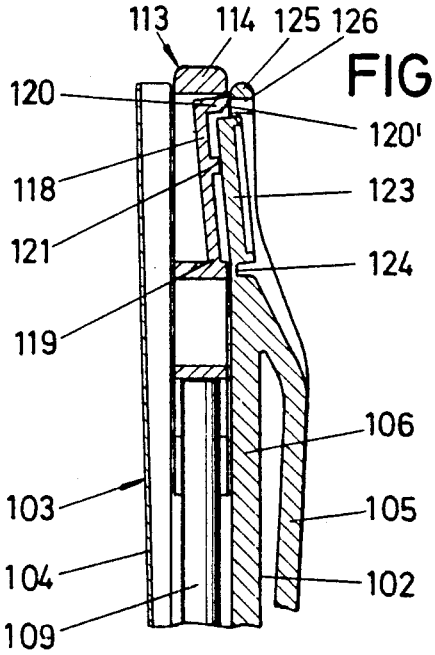
FIG. 23 is a partly broken-away section corresponding to FIG. 22, the push-button plate being acted on, with release of the detent tongue.

The slide plate 113 has a tongue 118 cut from its wide side and protruding resiliently from the wide side, the base 119 of said tongue being located in the lower region. The free end of the tongue 118 has the detent tooth 120 with hasp-shaped run-on bevel 120', the tooth extending beyond the wide side of the slide plate 113. In the region between the detent tooth 120 and the base 119 there is a transmission projection 121 which is integral with the tongue. The slide plate 113 including the tongue 118 is an injection molding of plastic having elastic properties. In order to be able to coordinate the slide plate 113 easily with the ball-point pen housing 103 by mere insertion, run-on bevels 122 are arranged in front of the longitudinally directed cutouts 117 which are open towards the outside. This development permits the changing of the ball-point pen cartridge 109. For this purpose, the projections 116 are pressed inwards, whereupon the slide plate 113 can be pulled out and a new cartridge inserted. In front of the tongue 118 there extends a resiliently swingable push-button plate 123. It is of circular shape and is connected by a film hinge 124 to the ball-point pen housing. The butt joint 106 between the two shell parts 101, 102 extends through this push-button plate 123. The latter is flanked by a housing section 125 whose upper end is rounded and extends into the path of the detent tooth 120. The housing section 125 forms a notch 126 for the engagement of said tooth. The manner of operation is as follows: If the ball-point pen cartridge 109, starting from its retracted position, is to be brought into the writing position, then the slide plate 113 is moved in inward direction at its protruding rounded end 114. Simultaneously with this, the ball-point pen cartridge 109 is displaced against the compression spring force. During the displacement, the trap-shaped run-on bevel 120' of the detent tooth 120 strikes and runs on the housing section 125. The detent tongue 118 deflect resiliently in the inward direction. As soon as the detent tooth 120 lies at the height of the notch 126, the detent tooth 120 springs out beyond the wide side of the slide plate 113 and comes into the position shown in FIG. 22. The projections 116 have then also moved down to the other end of the cutouts 117. This secure detent position can only be eliminated intentionally, in the following manner: As shown in FIG. 23, the push-button plate 123 is swung in inward direction around the film hinge 124. In the process, it is applied against the transverse projection 121 of the detent tongue 118 and swings it so that the detent tooth 120 disengages from the housing section 125. The compression spring 110, via the ball-point pen cartridge 109, then moves the slide plate 113 back into the starting position, the ball-point pen cartridge coming into the retracted position.

In the embodiment it is shown that the housing 103 and the holding clip 105 are integral with each other. It would also be possible to develop the holding clip together with the push-button plate as a unit which can be removed from the ball-point pen housing 103. The outer surface of the push-button plate 123 could also serve as inscription area.

The slide plate 113 is of rectangular shape in cross section and is surrounded in form-fitting manner by the shell parts 101, 102.

Since the actuating mechanism can be inserted before the connecting of the two shell parts, this results in advantages in the manufacture of the ball-point pen.

I claim:

1. In a ball-point pen comprising a housing which is non-round in cross-section at an upper region thereof, tapering towards a lower end thereof, a cartridge and a spring disposed about said cartridge inside of said housing and inwardly biasing said cartridge, a push button limitedly displaceable in a longitudinal direction of said housing for operatively extending said cartridge, and detent means for locking said push button in an inwardly pushed position of said push button, the improvement wherein the housing has a substantially flat shape at said upper region, said push button constitutes a slide plate substantially complementarily disposed in said flat shape of said upper region of said housing and substantially displaceable exclusively in said longitudinal direction of said housing and having a wide side, and forming a tongue at said wide side, said tongue being biased resiliently springing transversely out from said wide side of said slide plate, said tongue has a detent tooth releasably engageable with said housing, said tongue and said detent tooth comprising said detent means, a push-button plate resiliently swingable on said housing and disposed in front of said tongue of said slide plate pressable against said tongue to release engagement of said detent tooth from said housing in said inwardly pushed position of said push button, the push-button plate being substantially parallel to said wide side of said slide plate, and said housing forms a protection frame substantially framing said push-button plate.

2. The ball-point pen according to claim 1, wherein said push-button plate is resiliently swingably joined to said housing.

3. The ball-point pen according to claim 1, wherein said push-button plate is circular and is connected with said housing by a film hinge.

4. The ball-point pen according to claim 1, further comprising a transmission projection on said tongue between said tongue and said push-button plate.

5. The ball-point pen according to claim 1, wherein said housing further defines longitudinally directed recesses and said slide plate further comprises a plurality of outwardly protruding projections which extend into said longitudinally directed recesses of said housing.

6. The ball-point pen according to claim 5, wherein said housing is formed with run-on bevels arranged at the inside of said housing adjacent said longitudinally directed recesses.

7. The ball-point pen according to claim 5, wherein said longitudinally directed recesses extend through said housing from the inside to the outside.

8. The ball-point pen according to claim 1, wherein said detent tooth of said tongue is arranged on a free end of said tongue and said detent tooth has a run-on bevel formed as a hasp.

9. The ball-point pen according to claim 8, wherein said tongue has a base joined to said slide plate, said base of said tongue is located in the upper region of said slide plate.

10. The ball-point pen according to claim 1, wherein said housing comprises two shell parts which are connected to each other by a butt joint in a longitudinal plane.

11. The ball-point pen according to claim 10, wherein said two shell parts are connected by a film hinge on one side of the housing and are connected by a detent on the opposite side of the housing.

12. The ball-point pen according to claim 10, wherein said two shell parts are connected by a film hinge on one side of the housing and are connected by bonding on the opposite side of the housing.

13. The ball-point pen according to claim 10, wherein said two shells parts are connected by a film hinge on one side of the housing and are connected by welding on the opposite side of the housing.

14. The ball-point pen according to claim 10, wherein said housing further defines a clip and said longitudinal plane of said butt joint passes through said clip.

15. The ball-point pen according to claim 10, wherein said housing forming a flat side in said upper region transverse to the direction of said longitudinal plane of said butt joint, said lower end of said housing forming a tapering rounded section, said flat side has a film hinge connecting said two shell parts, and said flat side connects tangentially to said tapering rounded section.

16. The ball-point pen according to claim 15, further comprising a transmission projection on said tongue between said tongue and said push-button plate, said push-button plate and said slide plate including said tongue, said transmission projection and said tooth together comprises a cartridge-actuating mechanism, said mechanism being arranged in said upper region of said flat side.

17. The ball-point pen according to claim 1, wherein said slide plate is formed with cuts defining said tongue as a freely cut tongue with said resilient springing of said tongue being inherent.

18. The ball-point pen according to claim 17, wherein said slide plate with said tongue is formed as a one-piece injection molded member made of plastic.

19. The ball-point pen according to claim 1, wherein said housing is formed with a notch with which said detent tooth releasably engages in said inwardly pushed position of said push button.

20. The ball-point pen according to claim 1, wherein said push-button plate is substantially recessed within said frame in said inwardly pushed position of said push button.

21. In a device comprising a housing which is non-round in cross-section at an upper region thereof, tapering towards a lower end thereof, a cartridge and a spring disposed about said cartridge inside of said housing and inwardly biasing said cartridge, a push button limitedly displaceable in a longitudinal direction of said housing for operatively extending said cartridge, and detent means for locking said push button in an inwardly pushed position of said push button, the improvement wherein the housing has a substantially flat shape at said upper region, said push button constitutes a slide plate substantially complementarily disposed and substantially displaceable exclusively in said longitudinal direction in said upper region of said housing and having a wide side, and forming a tongue at said wide side, said tongue being biased resiliently springing transversely out from said wide side of said slide plate, said tongue has a detent tooth releasably engageable with said housing, said tongue and said detent tooth comprising said detent means, a push-button plate movable on said housing and disposed in front of said tongue of said slide plate pressable against said tongue to release engagement of said detent tooth from said housing in said inwardly pushed position of said push button, the push-button plate being substantially parallel to said wide side of said slide plate, and said housing forms a protection frame substantially framing said push-button plate.

22. The ball-point pen according to claim 21, wherein said push-button plate is a member separate from said housing and mounted movably with respect to said housing.

23. The device according to claim 21, wherein said push-button plate is substantially recessed within said frame in said inwardly pushed position of said push button.

* * * * *